US005802423A

United States Patent [19]

Okunishi

[11] Patent Number: 5,802,423

[45] Date of Patent: Sep. 1, 1998

[54] IMAGE FORMING APPARATUS WHICH SUPERVISES THE NUMBER OF TIMES AN IMAGE IS FORMED UNDER EACH USER IDENTIFIER

[75] Inventor: Kazuo Okunishi, Okazaki, Japan

[73] Assignee: Minolta Co., Ltd., Osaka, Japan

[21] Appl. No.: 900,827

[22] Filed: Jul. 25, 1997

[30] Foreign Application Priority Data

Jul. 26, 1996 [JP] Japan ..... 8-197413

[51] Int. Cl.[6] ..... G03G 21/00

[52] U.S. Cl. ..... 399/80; 399/366

[58] Field of Search ..... 399/80, 79, 81, 399/366, 38, 43

[56] References Cited

U.S. PATENT DOCUMENTS 4,260,878 4/1981 Kawamura et al. .
5,300,761 4/1994 Kasahara et al. ..... 399/79 X
5,610,688 3/1997 Inamoto et al. ..... 399/366

FOREIGN PATENT DOCUMENTS 56-66868 5/1981 Japan .

*Primary Examiner*—R. L. Moses
*Attorney, Agent, or Firm*—Burns, Doane, Swecker & Mathis, LLP

[57] ABSTRACT

An electrophotographic copying machine having a control unit is provided. The control unit comprises: a counting unit for counting the number of copies made by the copying machine; an identifier receiving unit for receiving a first identifier and a second identifier; an allowing unit for determining, after the identifier receiving unit has received the first identifier, whether a copying operation using the copying machine should be allowed under the first identifier; a judging unit for judging, after the allowing unit has allowed the start of a copying operation, whether the identifier receiving unit has received the second identifier; and a storage unit for storing the number of copies made under the second identifier after the judgement, if the judging unit has judged that the identifier receiving unit has received the second identifier, and the number of copies made under the first identifier after the judgement, if the judging unit has judged that the identifier receiving unit has not received the second identifier.

26 Claims, 8 Drawing Sheets

IMAGE FORMING APPARATUS WHICH SUPERVISES THE NUMBER OF TIMES AN IMAGE IS FORMED UNDER EACH USER IDENTIFIER

BACKGROUND OF THE INVENTION (1) Field of the Invention

The present invention relates to an image forming apparatus, such as a copying machine, which determines whether to permit an image forming operation depending on identifiers allocated to user sections.

(2) Related Art

In the conventional copying machine, a user inputs an identifier allocated to the section to which the user belong (such identifier will be hereinafter referred to as "user section ID"). The control unit in such copying machine compares the inputted user section ID with an identification number registered in the control unit beforehand (such identifier will be hereinafter referred to as "registered section ID"). Only if the user section ID is identical to the registered section ID, does the control unit permit the user to use the copying machine.

The control unit counts how may copies have been made under the user section ID, and stores the count value in relation to the user section ID.

A person in charge of supervising the use of the copying machine calculates the copy expenses according to the count value on a regular basis, and issues bills to the user sections.

Such copying machine stores the number of copies made in relation to the inputted user section ID when the use of the copying machine is allowed under the user section ID. Because of this, the following inconvenience is caused when the user makes copies at the request of a person from another section.

The user, who has received the request to make copies, inputs his/her own user section ID, and receives permission to use the copying machine. The user then makes copies which have been requested by the person from another section (hereinafter referred to as "requester section") However, the copying machine stores the number of copies made in relation to the user section ID. As a result, the user section, which has made the copies at the request of the requester section, will be charged for the copies. This will cause great inconvenience in supervising the copying expenses, because the section which will be charged for the copies is not the section which has actually made the request to make the copies.

To eliminate this problem, it might be possible to register the identification number of the requester section (this identification number will be hereinafter referred to as "requester section ID") beforehand, so that the use of the copying machine under the requester section ID can be permitted when the user, who has received the request to make copies, inputs the requester section ID directly into the copying machine. However, it is difficult to predict exactly when and by whom a request will be made, and to register the IDs of the section that will make a request. Registering all the section IDs is not preferable, either, not only because the registering process is complicated, but because an undesirably large number of sections will be allowed to use the copying machine.

SUMMARY OF THE INVENTION

The object of the present invention is to provide an image forming apparatus which can accurately count the number of times an image is formed under the identifier of each section even when an image forming operation using a copying machine of one section is requested from another section, so that copying expenses can be fairly charged.

This object can be achieved by providing an image forming apparatus having a control unit comprising: a counting unit for counting the number of times an image is formed by the image forming apparatus; an identifier receiving unit for receiving a first identifier and a second identifier; a determining unit for determining, after the identifier receiving unit has received the first identifier, whether an image forming operation using the image forming apparatus should be allowed under the first identifier; a judging unit for judging whether the identifier receiving unit has received the second identifier; and a storage unit for storing, if the judging unit has judged that the identifier receiving unit has received the second identifier, the number of times an image has been formed under the second identifier after the judgement.

The object of the present invention may also be achieved by providing an electrophotographic copying machine having a control unit comprising: a counting unit for counting the number of copies made by the copying machine; an identifier receiving unit for receiving a first identifier and a second identifier; an allowing unit for determining, after the identifier receiving unit has received the first identifier, whether a copying operation using the copying machine should be allowed under the first identifier; a judging unit for judging, after the allowing unit has allowed the start of a copying operation, whether the identifier receiving unit has received the second identifier; and a storage unit for storing the number of copies made under the second identifier after the judgement, if the judging unit has judged that the identifier receiving unit has received the second identifier, and the number of copies made under the first identifier after the judgement, if the judging unit has judged that the identifier receiving unit has not received the second identifier.

The object of the present invention may also be achieved by providing an image forming apparatus connected to other image forming apparatuses over a network, having a control unit comprising: a counting unit for counting the number of times an image is formed by the image forming apparatus; an identifier receiving unit for receiving a first identifier and a second identifier; a determining unit for determining, after the identifier receiving unit has received the first identifier, whether an image forming operation using the image forming apparatus should be allowed under the first identifier; a judging unit for judging whether the identifier receiving unit has received the second identifier; and a communication control unit for transmitting, if the judging unit has judged that the identifier receiving unit has received the second identifier, count value data calculated by the counting unit to another image forming apparatus corresponding to the second identifier over the network.

The object of the present invention may also be achieved by providing a method for controlling the number of times an image is formed by each of a plurality of image forming apparatuses connected over a network. This method comprises the steps of: determining whether a first identifier inputted into an image forming apparatus is identical to a identifier registered beforehand, and if it is, allowing an image forming operation using the image forming apparatus; judging whether a second identifier has been inputted; and storing the number of times an image is formed under the second identifier after a judgement is made that the second identifier has been inputted.

BRIEF DESCRIPTION OF THE DRAWINGS

These and other objects, advantages and features of the invention will become apparent from the following description thereof taken in conjunction with the accompanying drawings which illustrate a specific embodiment of the invention. In the drawings.

DESCRIPTION OF THE PREFERRED EMBODIMENTS

The following is an explanation of an embodiment of the present invention utilized in a two-color digital copying machine.

(1) Overall Structure of the Two-Color Digital Copying Machine

Figure 1:
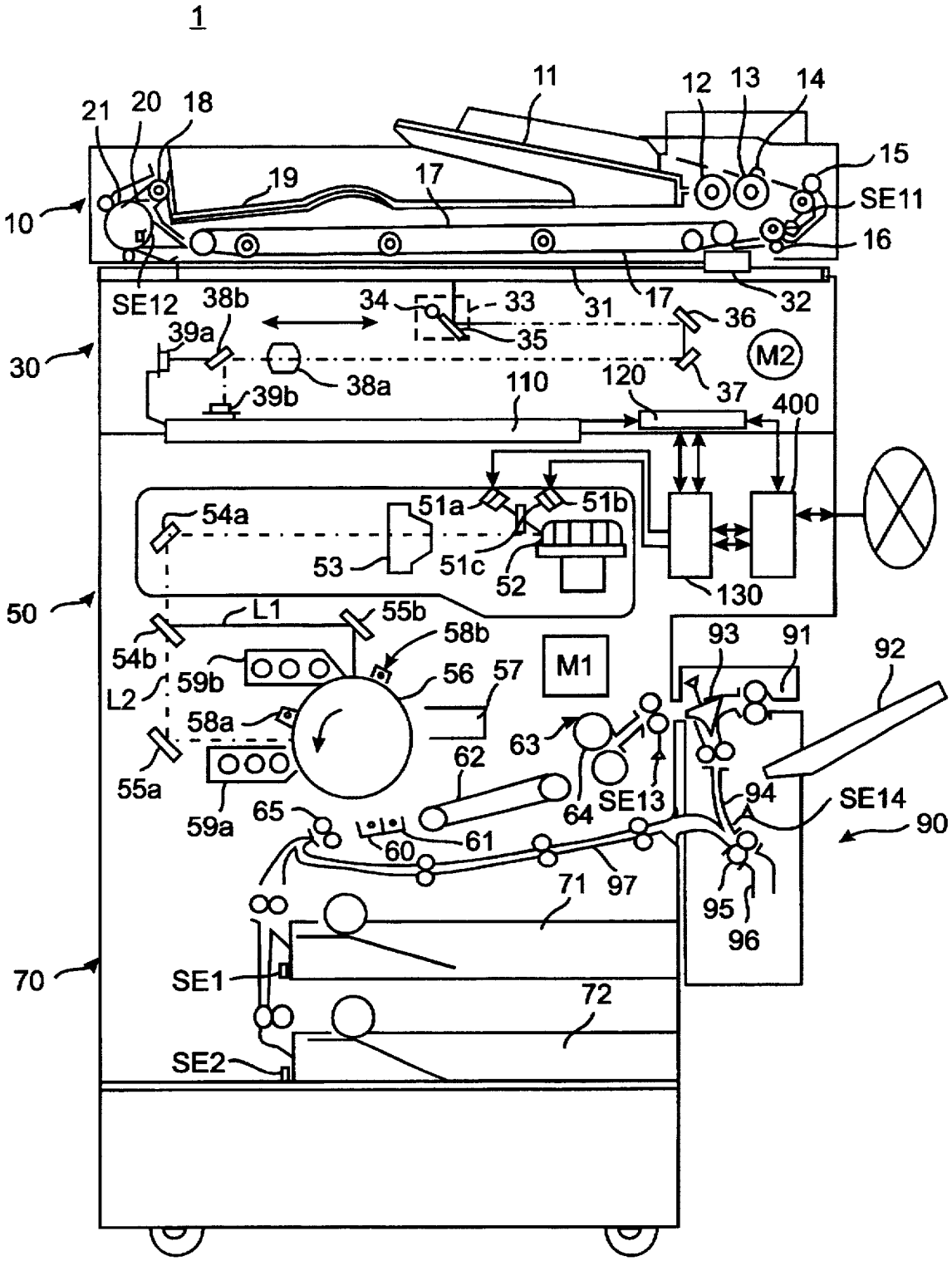
FIG. 1 shows the overall structure of the copying machine of an embodiment of the present invention.

FIG. 1 shows the overall structure of the two-color digital copying machine 1 (hereinafter referred to simply as "copying machine 1"). In this figure, the copying machine 1 comprises an automatic document transport unit 10, an image reading unit 30, a printing unit 50, a sheet feeding unit 70, and a re-feeding unit 90.

The automatic document transport unit 10 transports documents one by one to the image reading unit 30. A document placed on a document feed tray 11 are separated from one another by a document feed roller 12, a separating roller 13, and a separating pad 14. The document is then sent downward and transported by intermediate rollers 15, resist rollers 16, and a transport belt 17, to a document reading position restricted by a document scale 32 on a document glass plate 31.

After the document is scanned by a scanner 33 in the image reading unit 30, the drive of the transport belt 17 is re-started, and the document is discharged onto a document receiving tray 19 via a discharge roller 18.

When scanning both sides of a document, the document transport path is switched toward a reverse roller 21 by a switching claw 20, so that the document can be sent back onto the document glass plate 31 by turning the document over by the reverse roller 21. The document is thus transported to the document reading position on the document glass plate 31 by the transport belt 17.

After the reverse side of the document is scanned by the scanner 33, the transport belt 17 is driven toward the left so as to discharge the document onto the document receiving tray 19 in the same manner as described above, and to transport the next document from the document feed tray 11 to the document reading position.

The image reading unit 30 includes not only the scanner 33, which scans a document placed on the document glass plate 31 by moving in the direction of the arrow in FIG. 1, but also a converging lens 38*a* and CCD image sensors (hereinafter referred to as "CCD sensors") 39*a* and 39*b*.

The scanner 33 is driven by a scanner motor M2. The scanner 33 is provided with an exposure lamp 34 and a mirror 35 which reflects the reflection light from a document irradiated by the exposure lamp 34 in parallel with the document glass plate 31.

The reflection light from the mirror 35 is sent into a dichroic mirror 38*b* via mirrors 36 and 37, and the converging lens 38*a*. Here, the reflection light is divided into transmission light and reflection light and led to the CCD sensors 39*a* and 39*b*, respectively.

The features of the dichroic mirror 38*b* is that it reflects light of specific colors, such as red, and transmits light of the complementary colors of the specific colors, such as black (hereinafter referred to as "non-specific colors"). The CCD sensor 39*a* converts non-specific color images into electric signals, while the CCD sensor 39*b* converts specific color images into electric signals.

The electric signals of each color obtained by the CCD sensors 39*a* and 39*b* are converted into digital signals by an image signal processing unit 110. The digital signals are then subjected to shading correction, density conversion, and edge sharpening, and stored into a memory unit 120 as image data.

The image data of each color stored in the memory unit 120 are read by a print processing unit 130 and then converted into control signals for controlling the output of a laser diode 51*a* for the non-specific colors and the output of a laser diode 51*b* for the specific colors.

A printer unit 50 electrophotographically reproduces the image of a document read by the image reading unit 130 on the surface of a copying sheet. The laser diodes 51*a* and 51*b* in the printer unit 50 emit laser beams of different wave lengths in accordance with the control signals outputted from the print processing unit 130.

The two laser beams are united by a dichroic mirror 51*c*, and then reflected by the mirror surface of a polygon mirror 52 rotating at a predetermined angular velocity. The united laser beam is led to a dichroic mirror 54*b* via an fθ lens 53 and a mirror 54*a*, where it is again divided into a laser beam L1 for reproducing the specific colors and a laser beam L2 for reproducing the non-specific colors. The laser beams L1 and L2 exposes and scans the surface of a photosensitive drum 56 in two different positions.

Before being exposed by the laser beam L1 emitted from the laser diode 51*b*, the surface of the photosensitive drum 56 is cleared of the residual toner by a cleaning unit 57, neutralized by an eraser lamp (not shown), and uniformly sensitized by a sensitizing charger 58*a*. A latent image corresponding to the specific colors is formed after the laser beam exposes the surface of the photosensitive drum 56. The latent image is then developed by a developing unit 59*b* containing developer including red toner.

The photosensitive drum 56 further rotates to be sensitized by the sensitizing charger 58*a*, so that a latent image corresponding to the non-specific colors is formed on the surface of the photosensitive drum 56 by the laser beam L2 emitted from the laser diode 51*a*. This latent image is developed by a developing unit 59*a* containing developer including black toner.

Although the two laser beams for the specific and non-specific colors exposes in two circumferentially different positions on the surface of the photosensitive drum 56, they are able to form a reproduction image without color deviation by matching the toner image forming positions of red and black on the photosensitive drum 56, because the print processing unit 130 (shown in FIG. 3) delays the output of the image data of the non-specific colors against the output of the image data of the specific colors in synchronization with the rotation of the photosensitive drum 56.

The sheet feeding unit 70 feeds copying sheets of a predetermined size and includes two sheet cassettes 71 and 72. The sizes of the copying sheets contained in these cassettes are detected by photoelectric sheet size sensors SE1 and SE2. The detection signals are then sent to a CPU 415 in a print control unit 405 (shown in FIG. 3).

In synchronization with the exposure and developing operations of the photosensitive drum 56, copy sheets of a desired size are fed from one of the sheet cassettes 71 and 72 and transported to the transfer position on the bottom side of the photosensitive drum 56 via resistor rollers 65. The toner image of red and black formed on the surface of the photosensitive drum 56 is then transferred onto the surface of a copy sheet by means of the electrostatic power of a transfer charger 60.

The image transferred copy sheet is separated from the surface of the photosensitive drum 56 by a separation charger 61, and transported to a fixing unit 63 by a transport belt 62. The toner image transferred onto the copy sheet is heat-pressed in the fixing unit 63 by a fixing roller 64 having a heater inside. The image fixed copy sheet is then discharged onto a sheet receiving tray 92 via a transport path 91 in a re-feeding unit 90.

When forming a reproduction image on the back-side of a copy sheet (two-sided copy mode), the re-feeding unit 90 re-feeds the copy sheet having an image formed on the front surface to the transfer position on the photosensitive drum 56. In the two-sided copy mode, the left edge of a switching claw 93 of the re-feeding unit 90 is lifted upward so as to introduce the copy sheet into a transport path 94. The copy sheet is pushed toward a switchback transport path 96 by switchback rollers 95, and transported back to the transfer position on the bottom side of the photosensitive drum 56 via a transport path 97. By doing so, forming of an image on the back surface of the copy sheet is performed.

Two-sided copying may be completed on one copy sheet at a time, and discharged onto the sheet receiving tray 92 before starting the next two-sided copying. However, when two-sided copying is performed on a plurality of copy sheets, sheet feed control is conducted in the following manner.

Copy sheets are continuously fed from the sheet feeding unit 70 at suitable intervals, and an image is formed on the front surface of each copy sheet. When the first copy sheet approaches the resistor rollers 65 after passing through the transport path 97 via the re-feeding unit 90, the sheet feeding unit 70 stops the feeding operation. An image is then formed on the back surface of each copy sheet in the manner described above.

By doing so, the back-surface image forming can be continuously performed, and the speed of two-sided copying is improved, because the first copy sheet having an image already formed on the front surface is near the transfer position on the photosensitive drum 56 when the front-surface image forming is completed for a predetermined number of sheets.

Each of the sensors SE11 to SE14 arranged separately is a jam detecting sensor formed by a reflex photoelectric sensor having a light emitting element and an photoelectric conversion element. Such a sensor detects a transported copy sheet, and when it detects no copy sheet after a predetermined period of time since the last detection of the top edge of a copy sheet, the control unit 400 judges that a jam has occurred.

Figure 2:
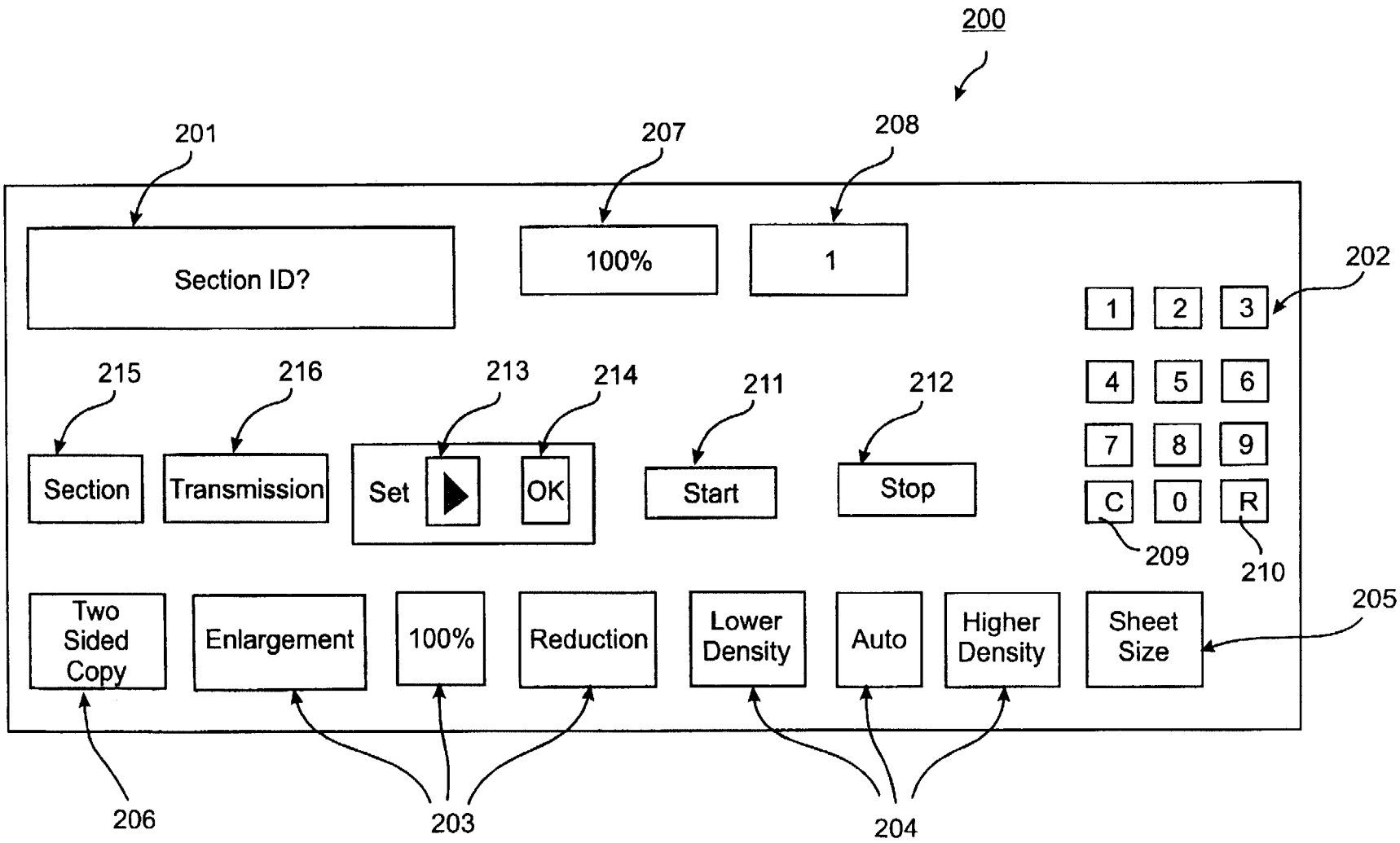
FIG. 2 shows the structure of the control panel.

An operation panel 200 shown in FIG. 2 is provided on the fore side of the image reading unit 30 so that it is easy for users to operate the copying machine. The operation panel 200 has a liquid crystal display 201 for displaying the name of each mode, a 10-key pad 202 for inputting the number of copies to be made and other setting, a magnification set key 203 for setting the copy magnification, a density set key 204 for setting image density, a sheet selection key 205 for selecting the size of copy sheet, a two-sided copy mode set key 206 for setting the two-sided copy mode, a magnification display 207 for displaying the copy magnification, a copy number display 208 for displaying the number of copies to be made, a clear key 209 for resetting the number of copies to be made to the initial value "1", a panel reset key 210 for resetting various conditions set in the copying machine, a start key 211 for starting a copying operation, a stop key 212 for stopping a copying operation, an item selection key 213 for selecting from items displayed on the liquid crystal display 201, a confirmation key 214 for confirming the item selected by the item selection key 213, a section key 215 for setting identification numbers for user sections and requester sections, and a transmission mode set key 216 for setting the destination of the image data and various control data when the copying machine is connected to other copying machines or a facsimile machine.

The liquid crystal display 201 displays not only a message to urge a user to input a section identification number, but also various cautions to inform users of a jam occurrence, emptiness of the sheet cassettes, and shortage of consumable supplies (toner).

(2) Structure of the Control Unit 400

Figure 3:
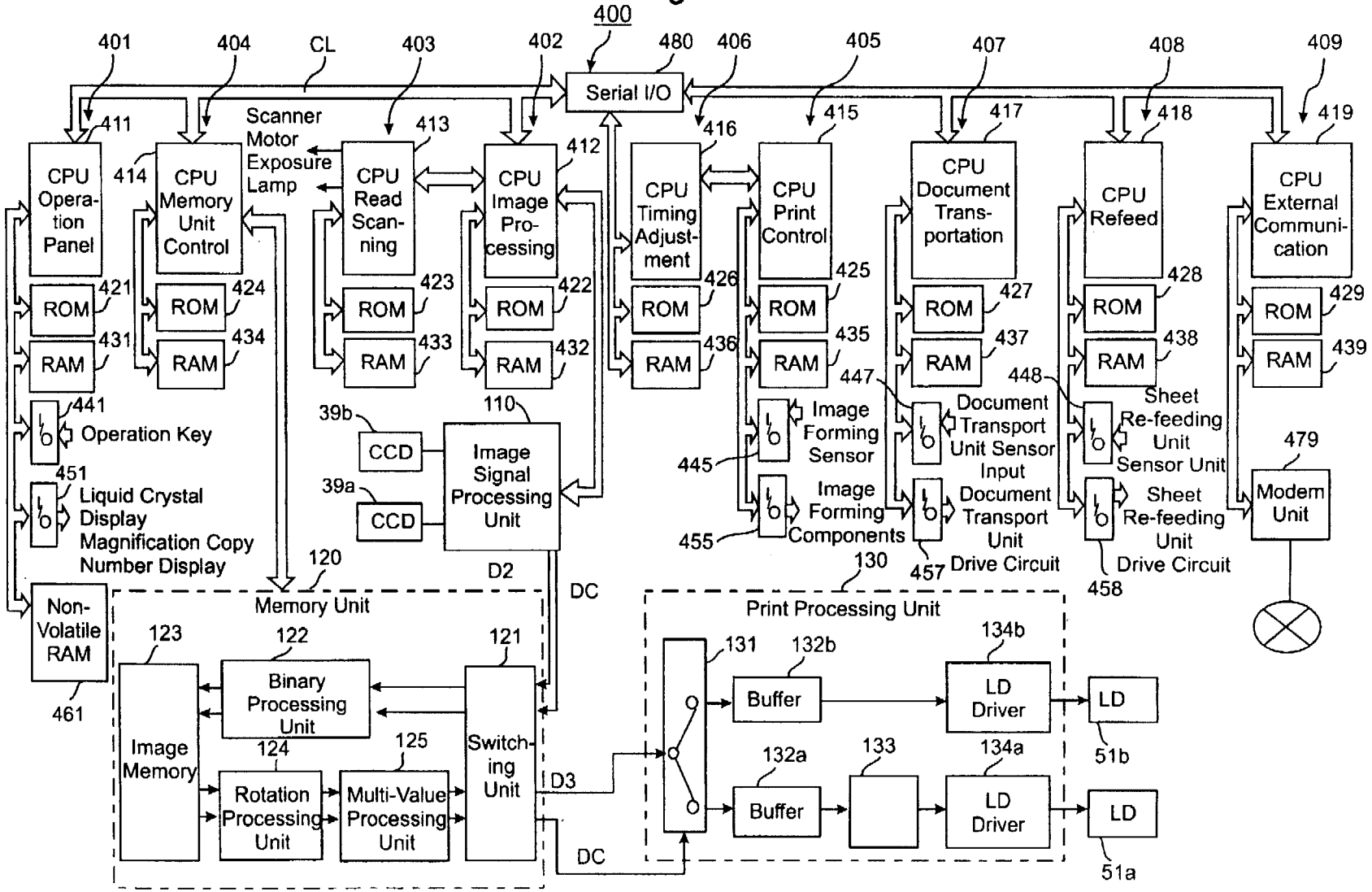
FIG. 3 is a block diagram showing the structure of the control unit in the copying machine.

FIG. 3 is a block diagram showing the structure of the control unit 400 provided in the copying machine 1. The control unit 400 comprises an operation panel control unit 401, an image processing control unit 402, a read scanning control unit 403, a memory unit control unit 404, a print control unit 405, a timing control unit 406, a document transport control unit 407, a re-feed control unit 408, and an external communication control unit 409.

CPUs 411 to 419 of the control units 401 to 409 are connected to each other via a command line CL and a serial I/O port 480 so that serial communication can be conducted among them to receive and transmit various commands, reports, and other data. ROMs 421 to 429 of the control units 401 to 409 each stores necessary programs for control operations, and according to these programs, the CPUs 411 to 419 controls other components. RAMs 431 to 439 serve as work areas for storing instructions from users and operation status of each component.

Each of the control units 401 to 409 is described below.

The operation panel control unit 401 transmits instructions inputted from the operation panel 200 to other control units, and also controls the displays on the operation panel 200. The CPU 411 receives signals from various operation keys on the operation panel 200 via an I/O port 441. The CPU 411 also controls the display contents of the liquid crystal display 201 (shown in FIG. 2) via an I/O port 451 and of the magnification display 207 and the copy number display 208. The ROM 421 stores a panel display program, while the RAM 431 temporarily stores various flags, and user section IDs and requester section IDs inputted from the operation panel 200. A non-volatile RAM 461 stores identification numbers of sections that are allowed to use the copying machine 1 (registered section IDs), and the count value of the number of copies in relation to user section IDs or requester section IDs.

The image processing control unit 402 controls the image signal processing unit 110. The image signal processing unit 110 includes an A/D converter, a shading correction unit, an MTF correction unit, a magnification change unit, a gamma correction unit, and a color discriminating unit.

Image data inputted from CCD sensors 39*a* and 39*b* are controlled by the CPU 412, and converted into an 8-bit digital multi-value signal by the A/D converter. The multi-value signal is subjected to unevenness correction by the shading correction unit, where the unevenness caused by the exposure lamp 34 and the CCD sensors 39*a* and 39*b* is corrected. The multi-value signal is then subjected to edge sharpening by the MTF correction unit for improving the image quality, magnification change by the magnification change unit, and gamma correction by the gamma correction unit. After all the processing operations, the memory unit 120 finally outputs the multi-value signal as image data D2. Here, the color discriminating unit also outputs 1-bit color data DC for indicating whether the image data are of a specific color or a non-specific color.

The read scanning control unit 403 controls the operation of the image reading unit 30. According to a control program stored in the ROM 423, the CPU 413 controls the rotation of the scanner motor M2 and the switching of the exposure lamp 34 so as to control the document scanning operation of the scanner 33.

The memory unit control unit 404 controls the operation of the memory unit 120. The image data D2 outputted from the image signal processing unit 110 and the color data DC of the image data D2 are temporarily stored in an image memory 123 of the memory unit 120, and outputted to the print processing unit 130 of the printer unit 50, when necessary.

The memory unit 120 consists of a switching unit 121 for switching between the input and output of image data, a binary processing unit 122 for digitizing image data based on parameters transmitted from the CPU 414, a multi-port image memory 123 having a predetermined memory capacity, an image shifting unit for shifting the direction of an image, and a multi-value processing unit 125 for producing multi-value data in accordance with parameters transmitted from the CPU 414.

The image data D2 inputted into the memory unit 120 are digitized by the binary Processing unit 122 and then written in the image memory 123 in relation to the color data DC. The image data of a page designated by an instruction sent from the CPU 414 are read from the image memory 123 together with the image data DC, and rotated by the rotation processing unit 124, if necessary. The image data are then converted into multi-value data by the multi-value processing unit 125 and outputted as image data D3 together with the color data DC to the print processing unit 130 via the switching unit 121.

The print control unit 405 collectively controls the operations of the print processing unit 130, the printer unit 50, and the sheet feeding unit 70, so that printing will be performed based on the image data D3 outputted from the memory unit 120. The ROM 425 stores a program for the print control, and according to the program, the CPU 415 inputs the image data D3 and the color data DC into the print processing unit 130, where the image data D3 and the color data DC are converted into driving signals of the laser diodes 51*a* and 51*b* before being outputted.

The print processing unit 130 includes a color selector 131 for switching the destinations of the image data D3 in accordance with the color data DC, two buffers 132*a* and 132*b*, a delay memory 133, and LD drivers 134*a* and 134*b* for driving the laser diodes 51*a* and 51*b*. When the color selector 131 receives the image data D3 and the color data DC outputted from the memory unit 120, it judges from the color data DC what color the image data D3 is. If the image data D3 is of a specific color, the image data D3 are sent to the LD driver 134*b* via the buffer 132*b*. The drive control of the laser diode 51*b* is conducted by the LD driver 134*b*. On the other hand, if the image data D3 is of a non-specific color, the image data D3 are sent to the delay memory 133 via the buffer 132*a*, where the image data D3 are delayed in accordance with the distance between the two exposure positions on the photosensitive drum 56. The drive control of the laser diode 51*a* is conducted by the LD driver 134*a*. The image forming positions of the red toner and black toner are thus matched so as to form a reproduction image without color deviation.

Upon forming an image, values detected by various sensors for image formation, such as a density detection sensor for detecting the amount of toner adhering to the photosensitive drum 56, a temperature sensor, and a humidity sensor (all of the sensor are not shown in the drawings) are inputted into the CPU 415 via an I/O port 445. The CPU 415 then controls the output of the sensitizing chargers 58*a* and 58*b*, and the transfer charger 60 via the I/O port 445 so as to optimize the reproduction image. The CPU 415 also controls the operation of the driving unit of each image forming component to perform printing on copy sheets.

Size detection signals are also inputted into the CPU 415 from the sheet size sensors SE1 and SE2 via the I/O port 445, so as to select a proper sheet cassette. The CPU 415 detects a paper jam from signals transmitted from the jam detecting sensors SE13 and SE14, and informs the CPU 411 of the paper jam so that the liquid crystal display 201 of the operation panel 200 will display a caution of "PAPER JAM".

The timing control unit 406 adjusts timing of the overall operation and operation mode setting of the control unit 400. The CPU 416 reads a necessary control program from the ROM 426, and monitors the timing of the operation according to the internal timer. The CPU 416 thus collectively controls the overall process routine by giving various commands and control data to other control units, achieving a smooth copying operation.

The document transport control unit 407 controls the operation of the automatic document transport unit 10. The CPU 417 controls the operation of each driving unit via an I/O port 457 in time with a control program stored in the ROM 427 so as to conduct transport control in transporting documents placed on the document feed tray 11 to the document reading position in the image reading unit 30.

The re-feed control unit 408 controls the operation of the re-feeding unit 90. The transport paths are switched between the two-sided copy mode and one-sided copy mode so that a copy sheet with an image formed on its front side can be discharged onto the sheet receiving tray 92, or that the copy sheet with an image formed on its front side can be turned over in the switchback transport path 96 and transported back to the transfer charger 60 for the back-surface image formation. The CPU 418, therefore, not only detects a paper jam according to the sensor input from the jam detecting sensor SE14 via an I/O port 448 but also controls the operation of each driving unit via an I/O port 458 according to a control program stored in the ROM 428.

The external communication control unit 409 controls the communication with other copying machines. The CPU 419 controls a modem unit 479 according to a control program stored in the ROM 429. In the transmission mode, the CPU 419 transmits the image data stored in the image memory 123 of the memory unit 120 and other control data to the other copying machines connected on the network. When receiving image data and control data from other copying machines, the CPU 419 transfers them to the memory unit control unit 404.

(3) Control Operation of the Panel Control Unit 401

Figure 4:
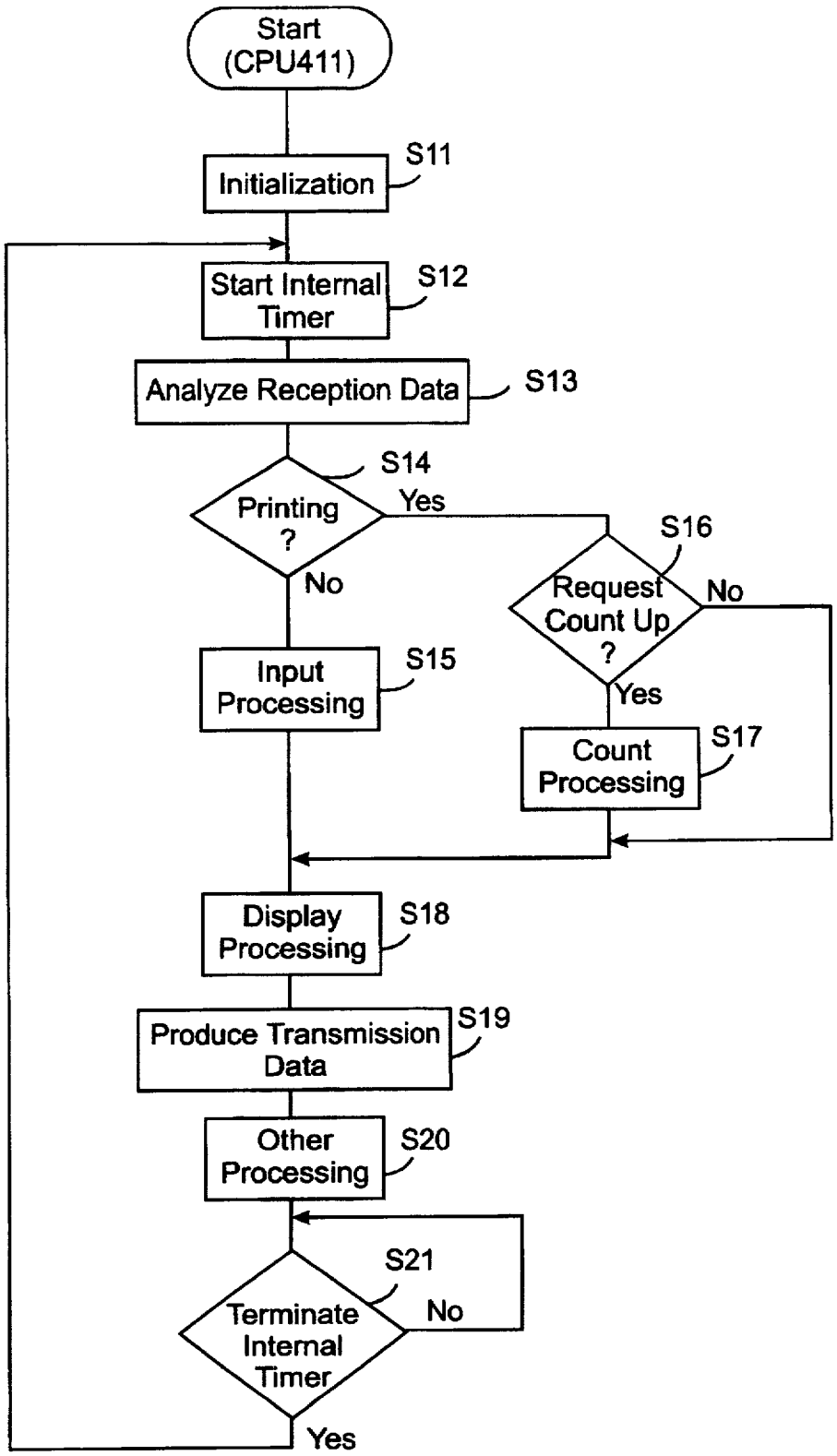
FIG. 4 is a flowchart showing the operation of the control panel control unit in the control unit.

Referring to the flowchart of FIG. 4, the following is an explanation of the control operation of the panel control unit 401 in the case where a user inputs a user section ID into the copying machine 1 so as to count how many copies have been made.

FIG. 4 is a flowchart showing the main routine of the CPU 411 of the operation panel control unit 401.

After switching on the copying machine, the CPU 411 initializes the internal resistor, the RAM 431, and others (step S11) The CPU 411 then starts the internal timer (step S12), performs the prescribed processing of steps S13 to S20, and monitors until the internal timer terminates (step S21). After the internal timer has terminated, the CPU 411 returns to step S12, and performs each processing of steps S13 to S20 at predetermined intervals set in the internal timer.

In step S13, the CPU 411 analyzes the contents of the reception data every time data are transmitted from any of the CPUs 412 to 419 by serial communication.

The CPU 411 next judges from the reception data whether printing is currently in progress (step S14). This judgement is made as a result of analysis of communication data transmitted from the CPU 416 for adjusting timing. If printing is not currently in progress, the CPU 411 advances to step S15 to perform input processing.

Figure 5:
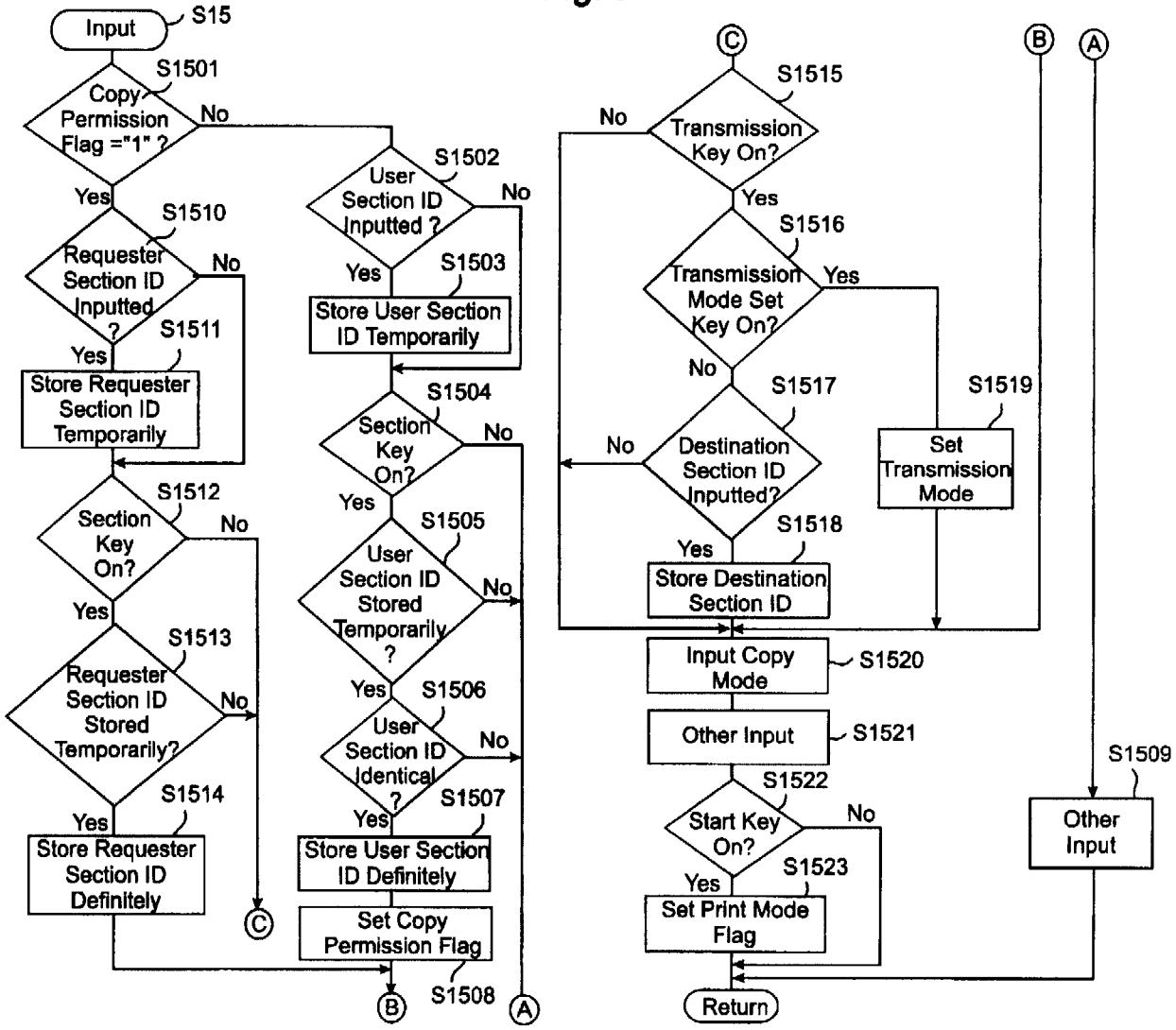
FIG. 5 shows the input processing subroutine (step S15 in FIG. 4)

FIG. 5 is a flowchart showing the input processing subroutine. Firstly, the CPU 411 judges whether a copy permission flag provided in the RAM 431 is "1" (step S1501). The copy permission flag is set to "1", if an inputted user section ID is identical to a register section ID in the copying machine (see step S1508). If the copy permission flag is not "1", the CPU 411 waits for a user section ID inputted from the operation panel 200, and upon receipt of a user section ID, the CPU 411 temporarily stores it into the RAM 421 (steps S1502 and S1503). When the section key 215 is pressed, the CPU 411 judges whether the user section ID is identical to a registered section ID in the non-volatile RAM 461, while making sure that the user section ID is temporarily stored (steps S1504, S1505, and S1506). If the user section ID is identical to a registered section ID, it is stored definitely, and the copy permission flag is set to "1" (steps S1507 and S1508). The CPU 411 then advances to step S1520.

In step S1520, the CPU 411 receives input concerning copy mode, such as the number of copies to be made and magnification. In step S1521, the CPU 411 further receives other necessary input concerning maintenance operation, for instance. When the start key 211 is pressed, a print mode flag Provided in the RAM 431 is set to "1" (steps S1522 and S1523), and the CPU 411 returns to the main routine.

The copy Permission flag is not set to "1" in the following cases: when the section key 215 is not pressed even though a user section ID has been inputted ("No" in step S1504); when the section key 215 is pressed without inputting any user section ID, and therefore no user section ID is temporarily stored ("No" in step S1505); or when the section key 215 is pressed after the input of a user section ID, but the user section ID is not identical to a registered section ID ("No" in step S1506). In the above cases, the CPU 411 advances to step S1509 to perform other input processing concerning maintenance and miscellaneous matters, and then returns to the main routine.

Through the processing of steps S1502 to S1508, the copy permission flag is set to "1" only if a user section ID inputted by the user is identical to a registered section ID, so that those who do not belong to the firm will be prohibited from the use of the copying machine.

If the copy permission flag is "1" in step S1501, a user section ID has been already inputted and copying is permitted. Here, the CPU 411 further judges whether a requester section ID has been inputted (step S1510). If a requester section ID has been inputted, the CPU 411 stores it into the RAM 431 temporarily (step S1511). When the section key 215 is pressed, the CPU 411 stores the requester section ID definitely (steps S1512, S1513, and S1514), and performs the processing of steps S1520 to S1523 before returning to the main routine.

If the section key 215 is not pressed even though a requester section ID has been inputted ("No" in step 1512), or if the section key 215 is inadvertently pressed without inputting any requester section ID in step S1510 and therefore no requester section ID is temporarily stored ("No" in step S1513), the CPU 441 advances to step S1515 to perform necessary setting processing concerning transmission mode.

When the CPU 411 judges that the transmission key 216 has been pressed in step S1515, it further judges whether the transmission mode set key has been pressed (step S1516). The transmission mode set key is not shown in FIG. 2, but the confirmation key 214 corresponds to the transmission mode set key when the item selection key 213 is pressed to display "set transmission mode" on the liquid crystal display 201.

In the case where the transmission mode set key has not been pressed in step S1516, the section identification number of another copying machine connected to the present copying machine via a telephone line (this identification number will be hereinafter referred to as "destination section ID") is inputted, and then stored into the RAM 431 (steps S1517 and S1518). In the case where the transmission mode set key has been pressed when the CPU 411 comes back to step S1516 after going through the subroutine, the CPU 411 enters transmission mode (step S1519). The CPU 411 then performs the processing of steps S1520 to S1523, and returns to the main routine.

In the processing of steps S1515 to S1519, the user inputs a destination section ID by pressing the transmission key 216, and sets the transmission mode by pressing the transmission mode set key.

Referring back to the flowchart of FIG. 4, the input processing of step S15 is performed, followed by the display processing of step S18. In the display processing, the CPU 411 controls the contents of the liquid crystal display 201, the magnification display 207, and the copy number display 208. If an inputted user section ID is not identical to a registered section ID in the non-volatile RAM 461, the CPU 411 controls the liquid crystal display 201 so as to display a message for urging the user to re-input a user section ID, and to display the initial image shown in FIG. 2 after a certain period of time has passed.

The CPU 411 then produces data to be transmitted to the CPUs 412 to 419 (step S19). For instance, if the print mode flag is "1" (step S1523 in FIG. 5), the CPU 411 produces transmission data for informing the CPU 415 in the Print control unit 405, and stores the transmission data into a transmission ring buffer provided in the RAM 431.

The CPU 411 then performs other processing, such as transmitting the transmission data to the CPUs 412 to 419 (step S20). When the internal timer stops (step S21), the CPU 411 returns to step S12.

If printing is in progress in step S14, the CPU 411 judges from the analysis of the reception data whether a count-up request has been transmitted (step S16). If a count-up request has been transmitted, the CPU 411 determines, from the requester section ID and the destination section ID inputted in the subroutine of step S15, to which section the copy count is added. The CPU 411 then performs count processing for counting up the copy counter of the section (step S17).

The count-up request is transmitted from the CPU 416 in the timing control unit 406. The CPU 416 transmits the count-up request to the CPU 411 every time it receives a print report transmitted in one printing operation from the Print control unit 405, or a transmission report transmitted every time one page of image data are transmitted outwardly from the external communication control unit 409.

Figure 6:
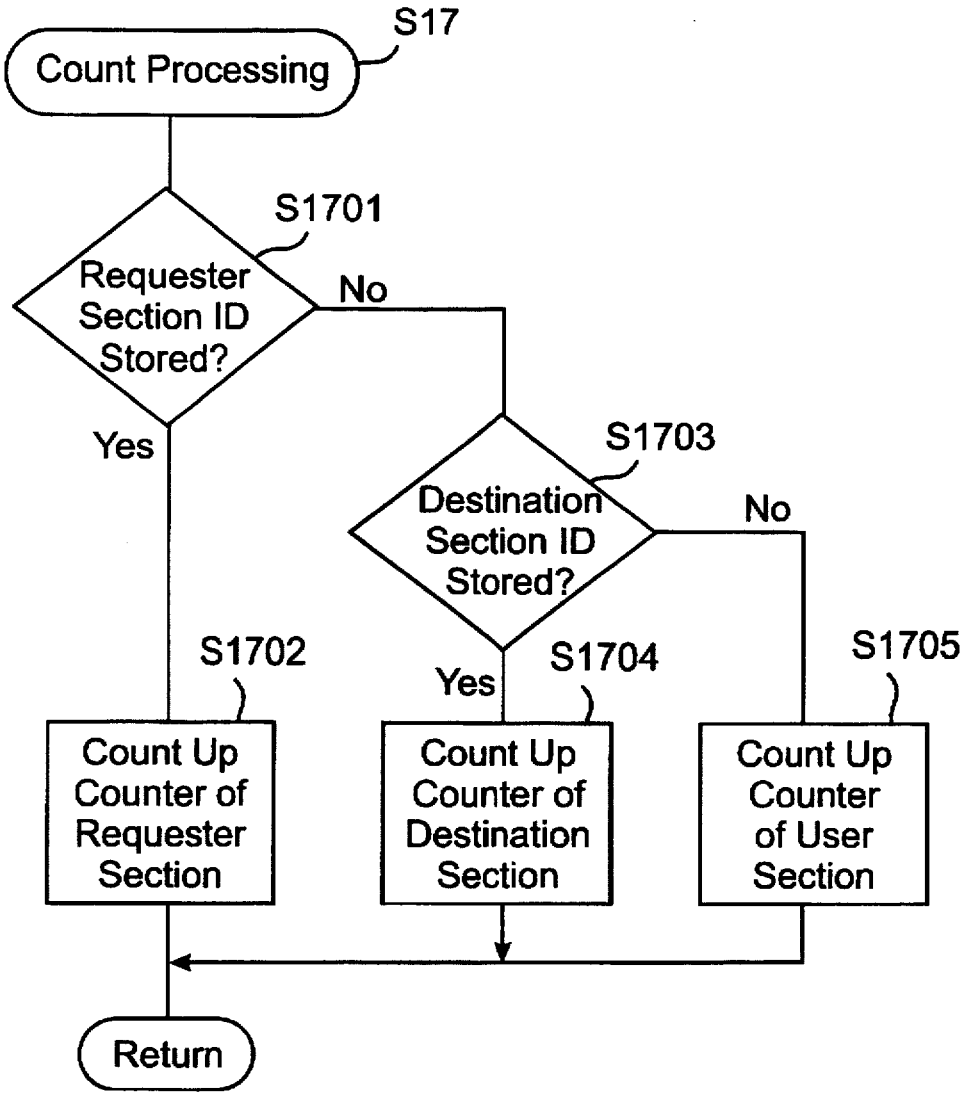
FIG. 6 shows the count processing subroutine (step S17 in FIG. 4)

FIG. 6 is a flowchart showing the subroutine of the count processing of step S17. As shown in this subroutine, the CPU 411 first judges whether a requester section ID is stored in the RAM 431 (step S1701). If it is, the CPU 411 counts up the counter corresponding to the requester section ID (step S1702).

If no requester section ID is detected in step S1701, the CPU 411 judges whether a destination section ID is stored in the RAM 431 (step S1703). If it is, the CPU 411 counts up the counter corresponding to the destination section ID (step S1704).

If neither requester section ID nor destination section ID is detected in steps S1701 and S1703, the CPU 411 counts up the counter corresponding to the inputted user section ID (step S1705).

The non-volatile RAM 461 has a tabulation table for storing the number of copies made under each section ID. In the above description, a "counter" refers to a storage area that holds the number of copies permitted for each section ID in accordance with the tabulation table. "Count up" refers to an increment operation in which the number of copies on the "counter" is added by 1 every time a count-up request is transmitted.

After a section to which the count-up is performed is determined in the flowchart, the ID of the section is registered in the tabulation table, and the counter corresponding to the section ID is counted up. If the section ID has already been registered in the tabulation table, it is not necessary to register the section ID for the second time to count up the counter corresponding to the section ID.

When a series of copying operations under the inputted user section ID are completed, the storage area of each section ID temporarily stored in the RAM 431 is cleared, and awaits the next input of user section ID. Here, the CPU 411 judges whether a series of copying operations are completed when certain input is made by the user from the operation panel 200, or when no input has been made for a certain period of time since the completion of the last copying operation.

After the count processing of step S17 in FIG. 4, the CPU 411 performs the processing of steps S18 to S21, and then returns to step S12, where it repeats the same operation.

(5) Modifications

The present invention has been described by way of the above embodiment, but it should be understood that the scope of the present invention is not limited to the above embodiment, and that the following modifications are possible.

(5-1) In the above embodiment, the count value increases in response to a count-up request transmitted from the CPU 416. However, a limit number may be set in a RAM beforehand for the number of copies allowed to make by the copying machine, and the actual number of copies made is subtracted from the limit number every time a copy is made. In such a counting process, the copying operation is prohibited when the subtraction result is "0".

A limit number of copies may also be separately set for each section. The number of copies, which is added by "1" every time a copy is made under a corresponding section ID, is subtracted from the limit number, and when the subtraction result is "0", the copying operation under the corresponding section ID is prohibited.

(5-2) In the transmission mode in the above embodiment, the number of copies corresponding to each destination section ID in response to a count-up request from the CPU 416 is stored in the non-volatile RAM 461. However, the count-up request may be transmitted as control data to the destination copying machine via the external communication control unit 409, and the number of copies is added in relation to the destination section ID in the destination copying machine. Instead of a count-up request, a count result stored in the non-volatile RAM 461 may be transmitted as control data to a destination copying machine via the external communication control unit 409 after a series of copying operations, and the number of copies is calculated in the destination copying machine.

When performing a copying operation according to image data transmitted from another copying machine to the present copying machine, the number of copies may be counted in the same manner as described above by receiving a count-up request or a count result from the external apparatus.

(5-3) A requester section ID and a destination section ID are selectively inputted in the above embodiment. However, since entering the transmission mode is not necessarily profitable to the destination section, a destination section ID and a requester section ID (or the ID of a section which wishes to make copies by a copying machine of another a section) are received together, and when performing the transmission mode, the counter corresponding to the requester section ID is counted up.

(5-4) In the case where a large number of copying machines are connected to form a large-scale copying machine supervisory system, the copying machines may be connected to a counting unit for counting the number of copies, such as a host computer, over a network, and using the counting unit, the number of copies of each section is collectively controlled.

Figure 7:
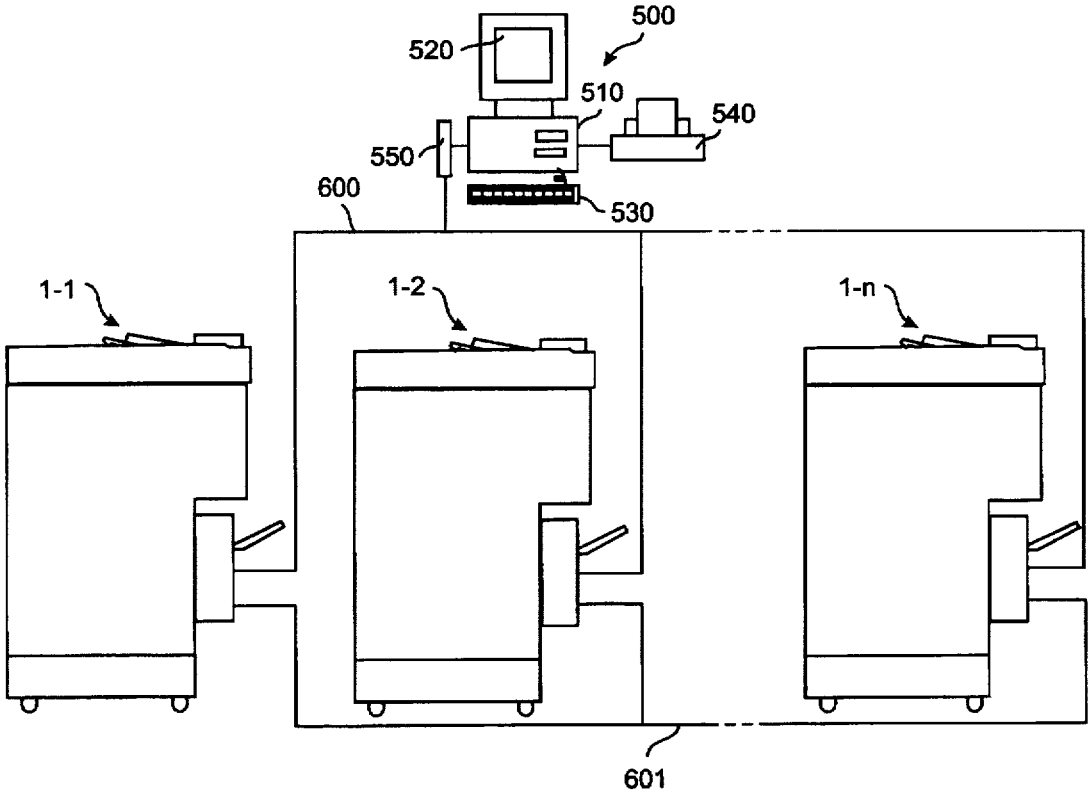
FIG. 7 shows the overall structure of the image formation control system including a host computer.

FIG. 7 shows the overall structure of a copy number control system in which a host computer 500 is connected to a plurality of copying machines 1-1 to 1-n over a network, so that the number of copies made under each section ID by each copying machine can be counted up by the host computer 500.

The copy number control system includes the host computer 500 provided at the service center, and a plurality of user copying machines 1-1 to 1-n provided on each floor of a building or in each section of a firm.

The modem 550 of the host computer 500 is connected to each of the copying machines 1-1 to 1-n via a telephone line 600. The copying machines 1-1 to 1-n are connected to each other via private lines 601.

The host computer 500 comprises a main frame 510, a display 520, a keyboard 530, a printer 540, and the modem 550.

Figure 8:
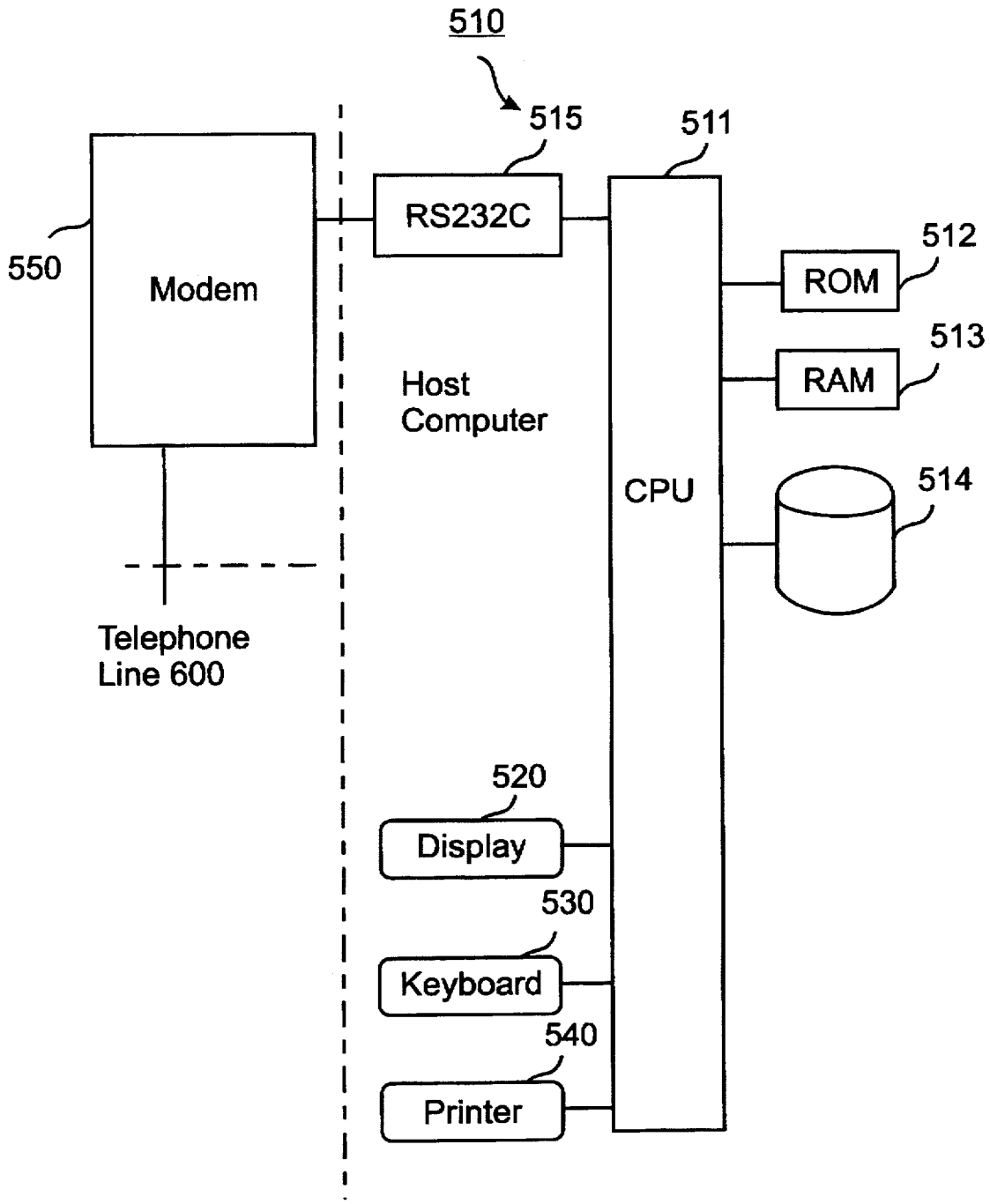
FIG. 8 is a block diagram showing the structure of the host computer.

As shown in FIG. 8, the computer main frame 510 is structured around the CPU 511, including a ROM 512 for storing a copy number control program and a communication control program, a RAM 513 as a work area when executing each program, a hard disk 514 for storing a control table containing the total number of copies made under each section ID of all the sections to be supervised and a variety of data transmitted from the copying machines 1-1 to 1-n, and a communication interface (RS232C) 515 for communicating with the outside via the telephone line 600. The computer main frame 510 communicates with the other copying machines 1-1 to 1-n via the modem 550.

Clerks at the service center orders the host computer 500 to regularly inquire the number of copies made under each section ID stored in each of the copying machines 1-1 to 1-n. According to the response from each copying machine, the host computer 500 updates the number of copies made under each section ID. The clerks at the service center display it on the display 520 or print it out from the printer 540, and issue a bill to each section according to the updated copy number data.

The number of copies may be supervised in the following manner as well.

Firstly, a user section ID is inputted into a copying machine 1-m which is one of the copying machines 1-1 to 1-n. After the use of the copying machine 1-m is permitted and the count transmission destination is determined, a count destination section ID and a count-up request are sent to the host computer 500 via the telephone line 600 every time a copy is made by the copying machine 1-m. in response to the count-up request, the host computer 500 counts the number of times a copy has been made, and stores the number of times a copy has been made in relation to a corresponding section ID into the control table.

In such a case, after a user section ID has been inputted into the copying machine 1-m, the external communication control unit 409 transmits the user section ID to the host computer 500 via the telephone line 600, so that the host computer 500 can determine whether to allow the use of the copying machine. If a requester section ID or a destination section ID have been inputted into the copying machine 1-m, it is transmitted to the host computer 500, which in turn determines under which section the number of copies is counted up.

(5-5) In the above embodiment, a copying machine which can transmit and receive image data and control data to and from other copying machines via a telephone line using a modem. When data transmission is conducted without network connection, however, the communication function is not essential and can be omitted. In such a case, the external communication control unit 409 of the control unit 400 shown in FIG. 3 is not necessary. Steps S1515 to S1518 in setting the transmission mode in the input processing subroutine shown in FIG. 5, and steps S1702 and S1705 in the count processing shown in FIG. 6 are not required, either.

(5-6) In the above embodiment, an electrophotographic copying machine which can communicate with other electrophotographic copying machines via a telephone line using a modem. In the case where an electrophotographic copying machine is connected over a network, such as an in-house LAN, the external communication control unit 409 may control network communication. In such a case, a modem is not essential, and thus, the modem unit 47 of the control unit 400 shown in FIG. 3 can be omitted.

(5-7) In the above embodiment of the present invention, the number of copies made under each section ID and the transmission control for other copying machines are controlled by the operation panel control unit 401 and the external communication control unit 409, respectively, of the control unit 400 in the copying machine. However, apart from the control unit 400, a control apparatus having the above-mentioned control function is provided, and connected to the control unit 400 of the copying machine via a connector.

(5-8) A two-color digital copying machine is taken as an example in the above description of the embodiment, but the present invention may also be applied to other image forming apparatuses, such as color or non-color copying machine, printer, and facsimile machine.

Although the present invention has been fully described by way of examples with reference to the accompanying drawings. It is to be noted that various changes and modifications will be apparent to those skilled in the art.

Therefore, unless otherwise such changes and modifications depart from the scope of the present invention, they should be construed as being included therein.

What is claimed is:

1. An image forming apparatus provided with a control unit which comprises:

a counting unit for counting the number of times an image is formed by the image forming apparatus;

an identifier receiving unit for receiving a first identifier and a second identifier;

a determining unit for determining, after the identifier receiving unit has received the first identifier, whether an image forming operation of the image forming apparatus should be allowed under the first identifier;

a judging unit for judging whether the identifier receiving unit has received the second identifier; and a storage unit for storing, if the judging unit has judged that the identifier receiving unit has received the second identifier, the number of times an image is formed in relation to the second identifier after the judgement.

2. An image forming apparatus according to claim 1, wherein if the judging unit has judged that the identifier receiving unit has not received the second identifier, the storage unit stores the number of times an image has been formed in relation to the first identifier, the number of times being counted by the counting unit.

3. An image forming apparatus according to claim 1, wherein the determining unit includes: an identifier storage memory for storing an identifier under which the use of the image forming apparatus is allowed; and a comparing unit for comparing the first identifier inputted into the identifier receiving unit with the identifier stored in the identifier storage memory, and the determining unit allows an image forming operation using the image forming apparatus, if the first identifier is identical to the identifier stored in the identifier storage memory.

4. An image forming apparatus according to claim 3, wherein the identifier storage memory is a RAM.

5. An image forming apparatus according to claim 1, which is an electrophotographic copying machine, wherein the counting unit increments a count value in accordance with the number of copies made by the copying machine.

6. An image forming apparatus according to claim 1, which is a printer, wherein the counting unit increments a counter value in accordance with the number of times prints made by the printer.

7. An image forming apparatus according to claim 1, wherein the control unit further comprises:

a limit number storage memory for storing a limit number of times an image can be formed; and a decrement unit for decrementing the number of times an image has been formed by the counting unit from the limit number of times an image can be formed.

8. An image forming apparatus according to claim 7, wherein the control unit orders the determining unit to switch from an allowing judgement to a prohibiting judgement, when the decrement result of the decrement unit is 0.

9. An image forming apparatus according to claim 1, wherein the identifier receiving unit includes a 10-key pad on the operation panel of the image forming apparatus.

10. An electrophotographic copying machine provided with a control unit which comprises:

a counting unit for counting the number of copies made by the copying machine;

an identifier receiving unit for receiving a first identifier and a second identifier;

an allowing unit for determining, after the identifier receiving unit has received the first identifier, whether the start of a copying operation using the copying machine should be allowed under the first identifier;

a judging unit for judging, after the allowing unit has allowed the start of a copying operation, whether the identifier receiving unit has received the second identifier; and a storage unit for storing the number of copies made in relation to the second identifier after the judgement, if the judging unit has judged that the identifier receiving unit has received the second identifier, and the number of copies made in relation to the first identifier after the judgement, if the judging unit has judged that the identifier receiving unit has not received the second identifier.

11. An electrophotographic copying machine according to claim 10, wherein the counting unit increments the number of copies by 1 every time a copy is made by the copying machine.

12. An electrophotographic copying machine according to claim 10, wherein the allowing unit includes a RAM in which an identifier is registered beforehand, compares the first identifier inputted into the identifier receiving unit with the registered identifier, and allows the start of a copying operation using the copying machine if the first identifier is identical to the registered identifier.

13. An electrophotographic copying machine according to claim 12, wherein the allowing unit does not allow the start of a copying operation using the copying machine if the first identifier is not identical to the registered identifier.

14. An image forming apparatus connected to another image forming apparatus over a network, having a control unit which comprises:

a counting unit for counting the number of times an image is formed by the image forming apparatus;

an identifier receiving unit for receiving a first identifier and a second identifier;

a determining unit for determining, after the identifier receiving unit has received the first identifier, whether an image forming operation using the image forming apparatus should be allowed under the first identifier;

a judging unit for judging whether the identifier receiving unit has received the second identifier; and a communication control unit for transmitting, if the judging unit has judged that the identifier receiving unit has received the second identifier, count value data calculated by the counting unit to another image forming apparatus corresponding to the second identifier over the network.

15. An image forming apparatus according to claim 14, wherein the control unit further comprises a storage unit for storing, if the judging unit has judged that the identifier receiving unit has received the second identifier, the number of times an image is formed under the second identifier after the judgement.

16. An image forming apparatus according to claim 15, wherein if the judging unit has judged that the identifier receiving unit has not received the second identifier, the storage unit stores the number of times an image is formed in relation to the first identifier after the judgement.

17. An image forming apparatus according to claim 16, wherein the communication control unit transmits count value data to another image forming apparatus corresponding to the second identifier every time the counting unit counts up the number of times an image is formed, so that the count value in the image forming apparatus corresponding to the second identifier will be incremented accordingly.

18. An image forming apparatus according to claim 14, wherein the control unit further comprises a transmission mode setting unit for setting transmission mode, and the communication control unit transmits, when setting of the transmission mode, count value data obtained by the counting unit to another image forming apparatus corresponding to the second identifier.

19. An image forming apparatus connected over a network to a centralized control apparatus for supervising the number of times an image is formed, having a control unit which comprises:

a counting unit for counting the number of times an image is formed by the image forming apparatus;

an identifier receiving unit for receiving a first identifier and a second identifier;

a first transmitting unit for transmitting, after the identifier receiving unit has received the first identifier, the first identifier data to the centralized control apparatus, and after the identifier receiving unit has received the second identifier, the second identifier data to the centralized control apparatus; and a second transmitting unit for transmitting count value data calculated by the counting unit to the centralized control apparatus.

20. A centralized control apparatus connected to an image forming apparatus over a network for supervising the number of times an image is formed by the image forming apparatus, comprising:

a counting unit for counting the number of times an image is formed by receiving count value data from the image forming apparatus;

a determining unit for receiving a first identifier from the image forming apparatus, and then determining whether an image forming operation using the image forming apparatus should be allowed under the first identifier;

a judging unit for judging whether the image forming apparatus has transmitted a second identifier; and a storage unit for storing, if the judging unit has judged that the image forming apparatus has transmitted the second identifier, the count value of the counting unit in relation to the second identifier.

21. A centralized control apparatus according to claim 20, wherein if the judging unit has judged that the image forming apparatus has not transmitted the second identifier, the storage unit stores the count value of the counting unit in relation to the first identifier.

22. A method for supervising the number of times an image is formed by an image forming apparatus, comprising the steps of:

(1) determining whether a first identifier inputted into the image forming apparatus is identical to a identifier registered beforehand, and if it is, allowing an image forming operation using the image forming apparatus;

(2) judging whether a second identifier has been inputted; and (3) storing the number of times an image is formed in relation to the second identifier after a judgement is made that the second identifier has been inputted.

23. A method according to claim 22, the step (3) includes the step of storing the number of times an image is formed in relation to the first identifier after a judgement is made that the second identifier has not been inputted.

24. A method for supervising the number of times an image is formed by each of a plurality of image forming apparatuses connected over a network, comprising the steps of:

(1) determining whether a first identifier inputted into an image forming apparatus is identical to a identifier registered beforehand, and if it is, allowing an image forming operation of the image forming apparatus;

(2) judging whether a second identifier has been inputted; and (3) transmitting the number of times an image is formed in relation the second identifier after a judgement is made that the second identifier has been inputted.

25. A method according to claim 24, wherein the step (3) includes the steps of:

(3-1) storing the number of times an image is formed in relation to the second identifier after a judgement is made that the second identifier has been inputted; and (3-2) transmitting stored count value data to an image forming apparatus corresponding to the second identifier.

26. A method according to claim 25, wherein the step (3) includes the steps of:

(3-1) generating count value data every time an image is formed after a judgement is made that the second identifier has been inputted; and (3-2) transmitting the count value data to the image forming apparatus corresponding to the second identifier, so that the count value in the image forming apparatus corresponding to the second identifier will be incremented accordingly.

* * * * *